United States Patent [19]

Bizzarri

[11] 4,155,474

[45] May 22, 1979

[54] BOTTLE-SHAPED LIQUID CONTAINERS

[76] Inventor: Alfredo Bizzarri, via S. Donato 14/5, Florence, Italy

[21] Appl. No.: 901,781

[22] Filed: May 1, 1978

[30] Foreign Application Priority Data

May 6, 1977 [IT] Italy ..... 9435-A/77

[51] Int. Cl.[2] ..... B65D 23/00

[52] U.S. Cl. ..... 215/365; D9/21; D9/54; 40/310; 215/1 R

[58] Field of Search ..... 215/1 R, 365; D9/18, D9/20, 21, 22, 54, 55, 56, 57; 40/310

[56] References Cited

U.S. PATENT DOCUMENTS

| | | | |
|---|---|---|---|
| D. 2,928 | 2/1868 | Stearns | D9/20 |
| D. 34,783 | 7/1901 | Schies | D9/54 |
| D. 49,924 | 11/1916 | Graham | D9/55 |
| D. 109,755 | 5/1938 | Kelly | D9/57 |
| D. 217,757 | 6/1970 | Kozlowski | D9/20 |
| 1,602,391 | 10/1926 | Creaver | 215/1 R |
| 1,883,806 | 10/1932 | Martin | 215/1 R |

*Primary Examiner*—Donald F. Norton
*Attorney, Agent, or Firm*—McGlew and Tuttle

[57] ABSTRACT

A bottle-shaped liquid container has a body made up of three angularly spaced lobes of cylindrical form which merge into a bottle-neck portion of the container. The container which, for example, may contain wine, can be picked up by hand by gripping any one of the lobes. To facilitate this gripping, surface roughening is provided down the lobe sides. The roughening can take the form of raised indicia providing information on the liquid held in the container. The lobes give stability to the container both when upright and when on its side.

4 Claims, 4 Drawing Figures

BOTTLE-SHAPED LIQUID CONTAINERS

BACKGROUND OF THE INVENTION

1. Field of the Invention

This invention relates to bottle-shaped liquid containers in particular, but not exclusively, for wine.

2. Description of the Prior Art

At the present time in Europe there are two main types of wine bottle in common use. The first type is the 0.75 liter bottle which carries a controlled indication of the origin of the wine held in the bottle; this type of bottle is mainly intended for restaurants and examples include the 0.750 liter Bordeaux- or Rhine-bottle. The second type of bottle is the anonymous 2 liter bottle which contain common wines of all places of origin and are not required to carry an indication of the origin of the wine. These 2 liter bottles are large and their cylindrical form makes them cumbersome in use.

Under new regulations recently issued by the European Economic Community a requirement has been created for a special 1.5 liter container, intended for families for a wine with controlled indication of origin.

In developing a suitable distinctive 1.5 liter wine bottle to carry an indication of the wine contained in the bottle, it was also decided to try and develop a bottle which while being aesthetically pleasing would also avoid the disadvantages of plain cylindrical bottles, that is, the difficulty in gripping the large diameter of bottle required to give adequate internal volume and the instability of cylindrical bottles when laid on their side.

It is therefore an object of the present invention to provide a bottle-shaped container which by its external shape and by the distribution of the liquid mass inside the container facilitates the gripping and handling of the container even when it is quite heavy, and makes the pouring of the liquid into a glass easier regardless of how much liquid there is in the container.

It is a further object of the invention to provide a bottle-shaped container which has stability both when vertical and when in a horizontal lying position.

SUMMARY OF THE INVENTION

According to one aspect of the invention, there is provided a bottle-shaped liquid container comprising a body with three angularly distributed lobes of substantially cylindrical shape, and a central bottle-neck joined to the body, each of said lobes being easily clasped by hand for handling of the container, and the container being supportable in an approximately horizontal position by any two said lobes.

Advantageously, at the junction of the lobes with the bottle-neck the container is of substantially frusto-conical form enabling a ring shaped label to be applied about the container.

On the lobe sides embossed marks can be provided to convey information concerning the container contents and to give a better grip for handling. These marks may, for example, be embossed inscriptions running longitudinally along the lobe sides.

According to another aspect of the invention, there is provided a bottle of trefoil cross-section provided with external surface roughening to facilitate hand grip.

BRIEF DESCRIPTION OF THE DRAWINGS

A bottle-shaped liquid container embodying the invention will now be particularly described, by way of example, with reference to the accompanying drawing, in which.

DESCRIPTION OF THE PREFERRED EMBODIMENT

Figure 1:
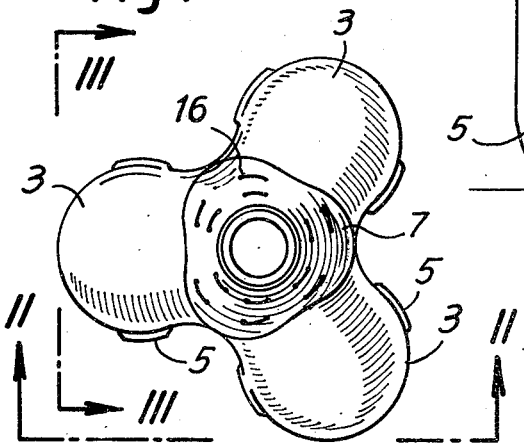
FIG. 1 is a plan view of the bottle-shaped container.

As shown in the drawing, the glass bottle-shaped container comprises a body 1 and a neck 9. The body 1 when viewed in plan (FIG. 1) can be clearly seen to be made up of three interconnected lobes substantially equi-angularly spaced around the container and approximately semi-circular at their outward ends to enable them to be easily held. Along the two sides of each lobe 3 are provided vertical embossed inscriptions 5 (for example: "Controlled indication of origin", repeated on each lobe side to thereby be displayed six times on the container). The inscriptions 5 form surface roughening which allows a better grip of a lobe 3. The body 1 and neck 9 merge with each other in a zone 7 which is substantially frusto-conical in shape and suitable for receiving a label.

The container thus has a number of features which facilitate handling and pouring particularly where the container is large, for example, of more than one liter in capacity, these features being the three-lobed form of the container (that is, a clover or trefoil section) with the lobes being semicircular at their outward ends and carrying grip-aiding embossed inscriptions down their sides. The provision of the inscriptions also ensures that the container can only be used without deception for particular wines.

When the container is picked up by any lobe 3 being gripped by hand, the palm and fingers and thumb of the hand readily conform to the lobe shape to give a snug fit and a good grip, this grip being further improved by the embossed inscriptions. During pouring with only one lobe gripped, the container will be balanced and not try to turn in the hand about the longitudinal axis of the container—this balance is most apparent if the lobe is held between the thumb and the middle finger and exists regardless of how full the container is because wine will always deposit in the two ungripped lobes which lie underneath, symmetrical with respect to the container axis (when the container is full or almost full, some wine will also reside in the container part above the lobes).

Figure 2:
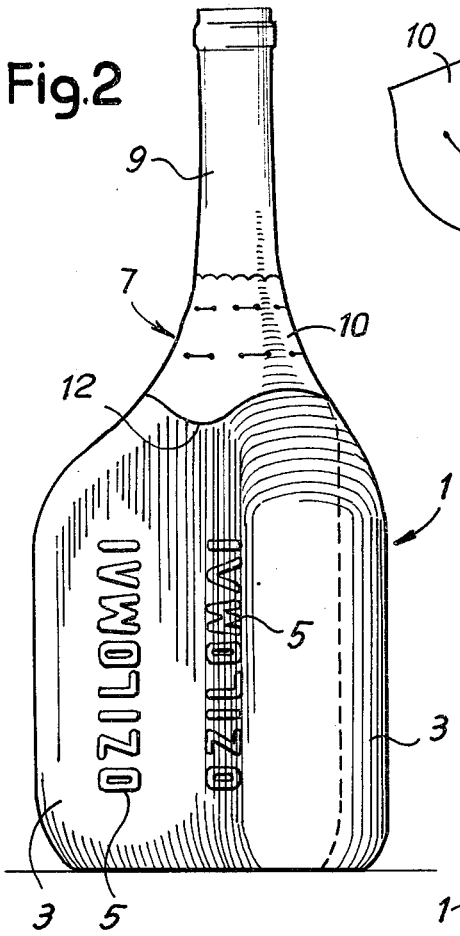
FIGS. 2 and 3 are elevations in the direction of arrows II—II and III—III respectively of FIG. 1.
Figure 4:
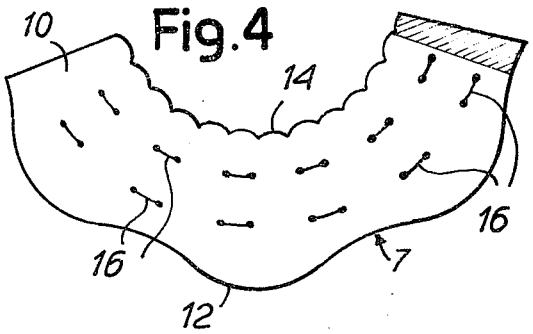
FIG. 4 is a developed view of a label shown applied to the container in FIGS. 1 to 3.
Figure 3:
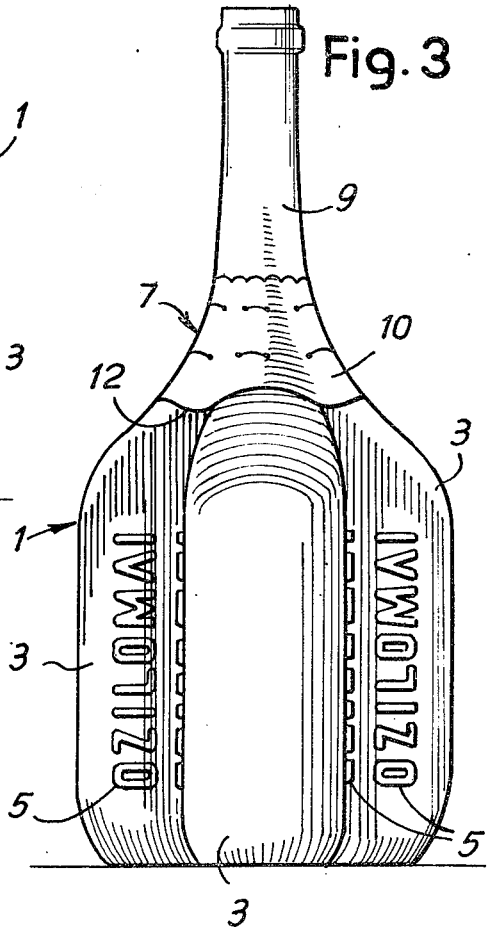

The label 10 (FIG. 4) consists of a bowed trapezoidal band, the outer arc of which is formed by three wide undulations 12 the crests of which when the label is applied around the container in the zone 7 seat between the lobes 3 while the troughs pass over the shoulders of these lobes to give a perfect fit of the bottom of the label to the profile of the container. The inner arc of the label 10 is formed by small undulations which facilitate adherence of the label to the container around the top of the label (this being the most critical area). The label 10 also has two arcuate rows of slit 16 which facilitate positioning of the label by horizontal and circular pressure applied by a pad of slightly curved section. The position of the slits 16 maximises the space readily available for printing on. No labels are provided on the lobes 3.

The three lobed structure of the container gives it good stability in an upright position (the lobes acting as props or buttresses) and also enables the container to be placed on its side in a stable position (supported on two lobes).

From the foregoing it will be appreciated that the proposed form of container has been chosen for its functional advantages (easy grip by one of its lobes, instead of by the bottle-neck; balance; easy pouring; and stability both when upright and when on its side), and any aesthetic qualities of the container are by way of a bonus.

I claim:

1. A bottle-shaped liquid container comprising a body with three angularly distributed lobes of substantially cylindrical shape, and a central bottle-neck joined to the body, each of said lobes being easily clasped by hand for handling of the container and having first and second opposite sides each having embossed marks to facilitate gripping by the hand, and the container being supportable in an approximately horizontal position by any two said lobes.

2. A container according to claim 1, in which said marks are raised indicia.

3. A container according to claim 2, in which said raised indicia form inscriptions running longitudinally along each lobe side.

4. A bottle-shaped liquid container comprising a body with a central substantially triangular shaped portion having three sides with radially extending cylindrical portions forming hand engagement lobes of substantially cylindrical shape and having cross-sections greater than a half of a circle joined to a respective side of a central portion, said lobe portions being with axes at substantially 120° apart and being positionable in a horizontal position to support the bottle on two of said lobes, said bottle being shaped inwardly between said lobes in a curve substantially tangent to the juncture edges of said triangular central portion.

* * * * *